US005711436A

United States Patent [19]

Moeller et al.

[11] Patent Number: 5,711,436

[45] Date of Patent: Jan. 27, 1998

[54] COMBINATION DRINKING GLASS AND WINE GLASS RACK

[75] Inventors: Jens Peter Moeller, Odensen; Henrik Holbaek; Claus Jensen, both of Copenhagen, all of Denmark

[73] Assignee: Scanwood, Ryslinge, Denmark

[21] Appl. No.: 501,706

[22] Filed: Jul. 12, 1995

[30] Foreign Application Priority Data

Feb. 15, 1995 [DE] Germany ..... M 95 01 217.6

[51] Int. Cl.[6] ..... A47F 5/00

[52] U.S. Cl. ..... 211/94.5; 211/75; 211/106; D7/701; D7/704; 248/311.3; 248/312; 248/312.1

[58] Field of Search ..... 211/75, 74, 106, 211/88, 94, 94.5, 71; 248/311.3, 312, 312.1; D6/701, 704

[56] References Cited

U.S. PATENT DOCUMENTS

| | | | |
|---|---|---|---|
| D. 267,914 | 2/1983 | Lin | D6/113 |
| D. 308,924 | 7/1990 | Van Noord | D6/513 |
| 383,092 | 5/1888 | Baker . | |
| 1,311,975 | 8/1919 | Kroff | 248/220.31 X |
| 1,755,654 | 4/1930 | Kottke | 211/106 X |
| 1,925,540 | 9/1933 | Neuschotz | 248/23 |
| 2,230,975 | 2/1941 | Gratz | 312/113 |
| 2,600,096 | 6/1952 | Cooper et al. | 211/71 |
| 3,154,196 | 10/1964 | Loska et al. | 211/71 |
| 3,214,031 | 10/1965 | McCauley | 211/71 |
| 3,501,015 | 3/1970 | Behles | 248/220.41 X |
| 4,589,556 | 5/1986 | Peretz | 211/41 |
| 4,700,849 | 10/1987 | Wagner | 211/71 |
| 4,863,131 | 9/1989 | Kinseley | 248/312 X |
| 5,209,359 | 5/1993 | Arnold | 211/106 |

FOREIGN PATENT DOCUMENTS

| | | | |
|---|---|---|---|
| 259169 | 2/1965 | Australia | 211/74 |
| M9501217.6 | 4/1995 | Germany . | |

*Primary Examiner*—Robert W. Gibson, Jr.
*Attorney, Agent, or Firm*—Olive & Olive, P.A.

[57] ABSTRACT

A combination drinking glass and wine glass rack of the invention is adapted to receive both drinking glasses and wine glasses, and adjustable for accommodating varying sizes of glasses. The combination drinking glass and wine glass rack of the invention comprises a support board and at least one support arm pairs, each support arm pair comprising an downwardly angled arm and an upwardly angled arm. Each support arm comprises an upper rod portion and a lower rod portion. The lower rod portions of one support arm pair provide a support for the bases of drinking glasses and simultaneously a support from which wine glasses bases are suspended.

12 Claims, 5 Drawing Sheets

COMBINATION DRINKING GLASS AND WINE GLASS RACK

BACKGROUND OF THE INVENTION

1. Field of the Invention

This invention relates to a rack for supporting both drinking glasses and wine glasses.

2. Description of the Related Art

Many devices exist which provide a rack for wine glasses or drinking glasses. Devices exist, for example, which provide an apparatus from which wine glasses are suspended. Such types of devices include a slot between two supporting members through which the stems of an inverted wine glasses are inserted and upon which the bases of the wine glasses are supported. Examples of such devices are described in U.S. Pat. No. D267,914 of Lin entitled "Rack for Holding Stemware Glasses;" U.S. Pat. No. D308,924 of Van Noord entitled "Glassware Rack;" U.S. Pat. No. 1,925,540 of Neuschotz entitled "Brace or Bracket for the Support of Crockery, Glassware, Kitchen Utensils and the Like;" U.S. Pat. No. 2,230,975 of Gratz entitled "Combination Bar and Cabinet for Doors;" U.S. Pat. No. 3,154,196 of Loska, Jr., et al. entitled "Broad-Based Stemmed Glassware Rack;" and U.S. Pat. No. 4,700,849 of Wagner entitled "Combination Wine Rack and Glass Retention/Dispensing Assembly." Many of these devices are meant to be supported by the underneath surface of a shelf.

Additionally, some racks exist which are meant to be utilized in other devices, such as dishwashers, for example, U.S. Pat. No. 3,214,031 of McCauley entitled "Rack for Stemmed Glassware;" and U.S. Pat. No. 4,589,556 of Peretz entitled "Holder Assembly for Stemmed Glassware and Like Objects."

Still other devices attempt to provide racks that provide support for a bowl of a wine glass or a tea cup having a handle, for example, U.S. Pat. No. 383,092 of Baker entitled "Goblet Holder;" and U.S. Pat. No. 2,600,096 of Cooper et al. entitled "Cup Rack."

These devices, however, do not address the problem of a device being capable of supporting both wine glasses and drinking glasses. Typically, a rack for wine glasses is not suited to support drink glasses because of the different structures of the glasses. A drinking glass has a base and sides extending upward from the base; a wine glass has a base portion and a stem extending from the base portion to the bowl of the wine glass. Therefore, devices adapted to support the base of an inverted wine glass from which the wine glass is suspended are not adaptable for use with drinking glasses because they do not provide support for the sides of drinking glasses, or because they are meant to be supported underneath a shelf surface and therefore do not provide sufficient room above the rack to support a drinking glass. Additionally, these devices do not provide a device which is easily adjustable to accommodate varying sizes of wine and drinking glasses.

It is therefore an advantage of this invention to provide a rack which is suitable for both wine glasses and drinking glasses.

It is a further advantage of this invention to provide a rack which is easily adjustable to accommodate varying sizes of wine and drinking glasses.

SUMMARY OF THE INVENTION

The present invention is directed to a combination drinking glass and wine glass rack that is easily adjustable to accommodate varying sizes of glasses. Additionally, the combination rack of the invention is preferably adapted to be mounted on a wall. The combination drinking glass and wine glass rack of the invention comprises a support board having a top attachment row and a bottom attachment row; and at least one pair of support arms, each support arm comprising an upper rod portion and a lower rod portion, and each pair of support arms having a downwardly angled support arm adjacent to an upwardly angled support arm, such that when the pair of support arms is attached to the support board, the lower rod portions of the support arms form a support for a plurality of drinking glass bases and a support for suspending a plurality of wine glasses, and the upper rod portions of the support arms stabilize the drinking glasses positioned upon the lower rod portions. The support arms are further adjustably attachable on the support board such that varying sizes of glasses may be accommodated by the combination rack of the invention.

While the figures show use of the combination drinking glass and wine glass rack of the invention with particular styles of glasses, it is understood that other styles of glassware, including other stemware and tumbler styles are equally accommodated by the rack, for example, cordials, goblets, snifters, and the like. Additionally, use of the terms "drinking glass" and "wine glass" in this description are not meant to be limited to glasses made of glass, or to the style glass shown, but rather meant to generically describe drinking vessels, with or without stems.

Other aspects and features of the invention will be more fully apparent from the following disclosure and appended claims.

DETAILED DESCRIPTION OF THE INVENTION AND PREFERRED EMBODIMENTS THEREOF

Figure 1:
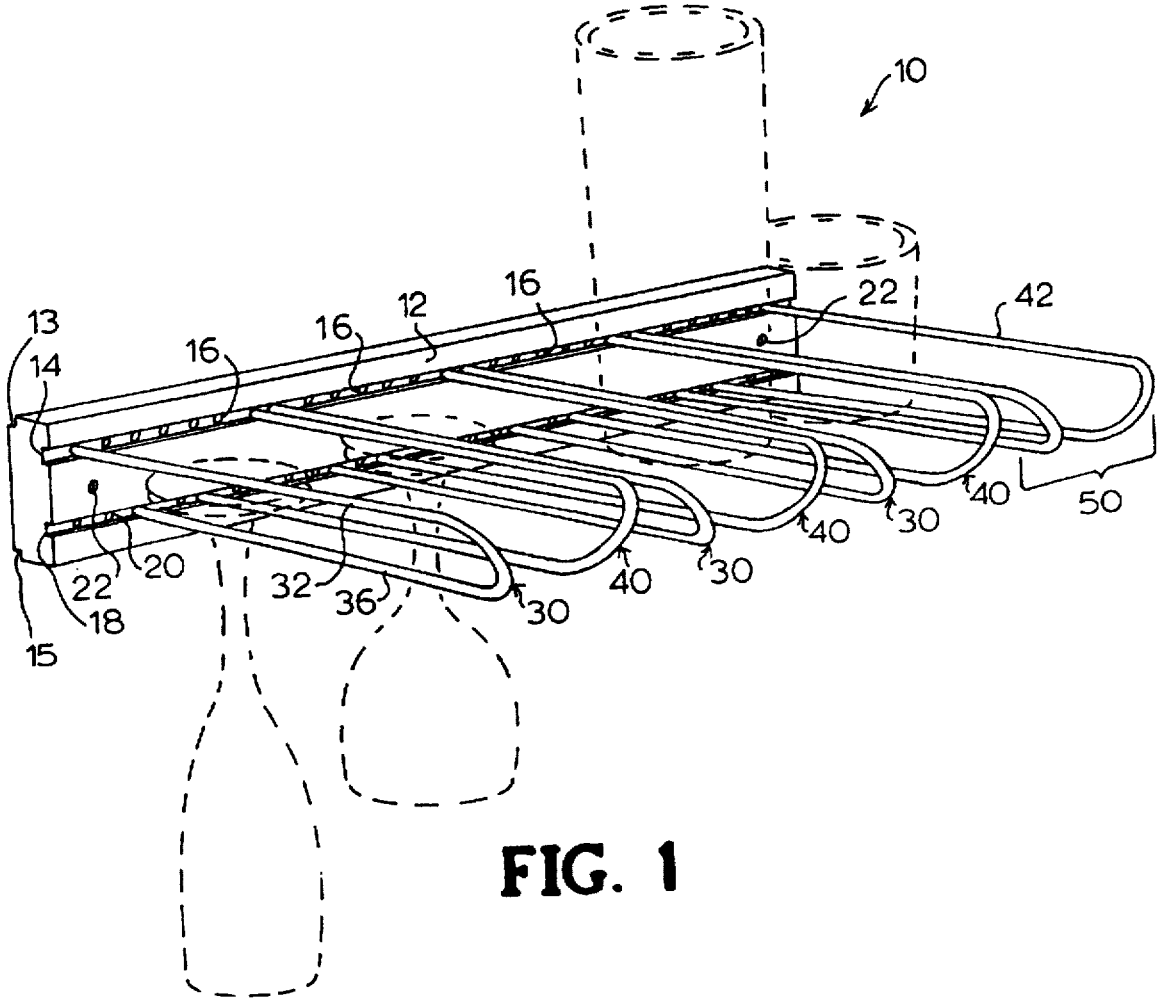
FIG. 1 is a perspective view of a combination drinking glass and wine glass rack of the invention, showing drinking glasses and wine glasses supported by the rack in phantom lines.

The present invention relates to a combination drinking glass and wine glass rack which accommodates both drinking and wine glasses and is easily adjustable to accommodate varying sizes of glasses. Referring to the Figures, FIG. 1 is a perspective view of the combination drinking glass and wine glass rack of the invention illustrating the combination rack in use with both wine glasses and drinking glasses shown in phantom lines. For purposes of the description, directional terms shall be determined from the orientation of rack 10 as shown in FIG. 1, showing rack 10 as if mounted on a wall. Above rack 10 is described as the upward direction, and below rack 10 described as the downward direction. The directional term "left" shall refer to the left end in FIG. 1, and "right" to the opposite side of rack 10 as shown in FIG. 1.

Combination rack 10 comprises mounting means 22, shown in FIGS. 1, 4, 5 and 8, for mounting rack 10 to a surface. Combination rack 10 is preferably mounted to a vertical surface, for example, a wall or a side of a cabinet, enabling drinking glasses to extend upwardly from rack 10, and enabling inverted wine glasses to be suspended from rack 10. Suitable mounting means 22 includes nails, screws and the like. Combination rack 10 comprises support board 12 and at least one pair 50 of support arms 30 and 40 adjustably attachable to support board 12 at top attachment row 14 and bottom attachment row 18. Support board 12 is constructed of a sturdy, solid material, preferably wood. Support board 12 can vary in dimensions according to the desired capacity for the rack 10. The longer support board 12, the greater number of rows of glasses are accommodated. Suitable, but not critical, dimensions for support board 12 are approximately 18½ inches long (47 cm) by approximately 2½ inches wide (6.5 cm) by approximately 1 inch (2.5 cm) thick. Support board 12 is optionally formed with groove 13 (FIGS. 1, 2, 5–7) and groove 15 (FIGS. 1, 3, and 5–7).

Figure 8:
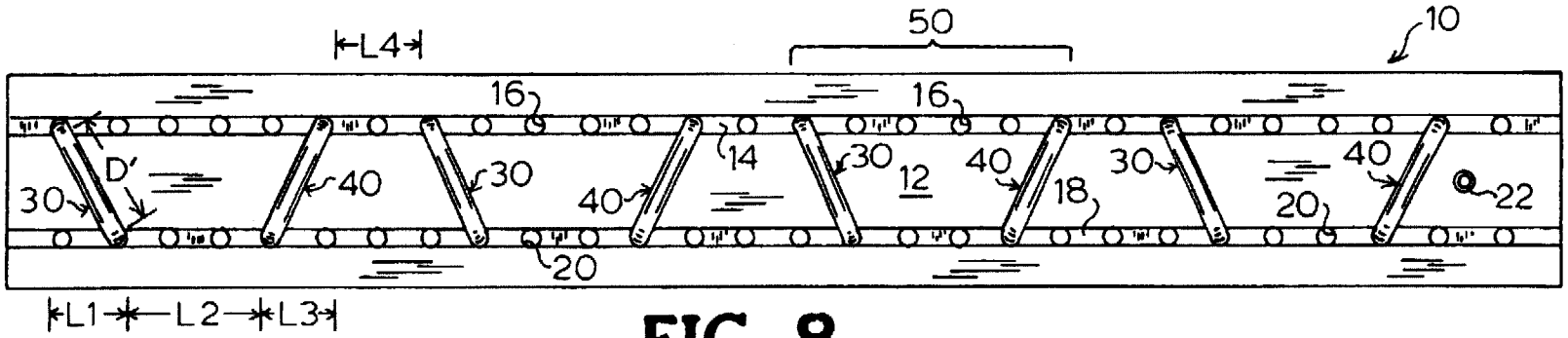
FIG. 8 is a front view of the combination drinking glass and wine glass rack showing an alternative arrangement of the support arms in the rack.
Figure 9:
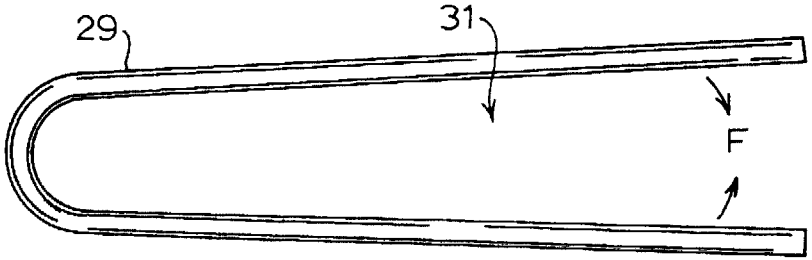
FIG. 9 is a top elevation view of one of the support arms of the combination rack of the invention with arrows indicating the inward flex of the rods of the support arm.

When not attached to board 12, support arms 30 and support arms 40 are identical structures, as shown in FIG. 9 numbered as support arm 29. When support arms 29 are attached to board 12, they differ in directional positioning on board 12 and are therefore designated in this description as different structures. When attached to board 12, support arms 30 are angled downward from left to right with respect to rack 10; support arms 40 are angled upward from left to right, FIGS. 1, 4 and 8. Each support arm 30 comprises upper rod portion 32 and lower rod portion 36; each support arm 40 comprises upper rod portion 42 and lower rod portion 46, as shown in FIGS. 2, 3, 5 and 6. Support arms 30 and 40 are preferably constructed from a metallic material, such as steel, so that rigidity is provided to the combination rack 10 and yet the support arms have limited flexibility for adjustable attachment to board 12. Preferably, support arms 30 and support arms 40 are each integral u-shaped pieces. While support arms 30 and 40 could be formed from individual rods (not shown) as opposed to integrally shaped pieces, integral arms 30 and 40 provide a more sturdy arrangement for supporting glasses in combination rack 10. The length of support arms 30 and 40 and the distance between upper rod portions 32 and lower rod portions 36, and upper rod portions 42 and lower rod portions 46, of a support arm 30 and 40 respectively, may vary according to the desired capacity for rack 10. Suitable dimensions for support arms 30 and 40 are as follows: approximately 10 inches in length (25 cm) and approximately 1½ inches to 2½ inches (3 cm to 7 cm) in width, the width being the unflexed distance between the upper and lower rod portions. The width may increase over the length of unflexed support arms 29, from the u-portion of arms 30 and 40 to an expanded open end. Additionally, arms 30 and 40 are flexible such that upper rod portions 32 and 42 are flexed toward lower rod portions 36 and 46 respectively, as illustrated in FIG. 9 as flex F.

Support arms 30 and 40 attach to board 12 at top attachment row 14 and bottom attachment row 18. Attachment rows 14 and 18 provide suitable means for attaching support arms 30 and 40, such as screws, brackets and the like. Preferably top attachment row 14 and bottom attachment row 18 form respectively a top row of apertures 16 and a bottom row of apertures 20 for attaching support arms 30 and 40, as discussed in more detail below. Top attachment row 14 and bottom attachment row 18 are preferably formed as recessed portions on support board 12, as shown in FIGS. 1, 4 and 6–8. Apertures 16 and 20 are formed in rows 14 and 18, respectively, of support board 12, for example by drilling, and preferably are of consistent and suitable width and depth for adjustably attaching support arms 30 and 40 to board 12. The distance between adjacent apertures 16, and adjacent apertures 20, is approximately ⅓ inch to 1 inch (1 cm to 2.5 cm). The dimensions and distances indicated as relating to apertures 16 and 18, board 12, and support arms 30 and 40 are suitable to accommodate most drinking glasses and wine glasses normally available.

Figure 2:
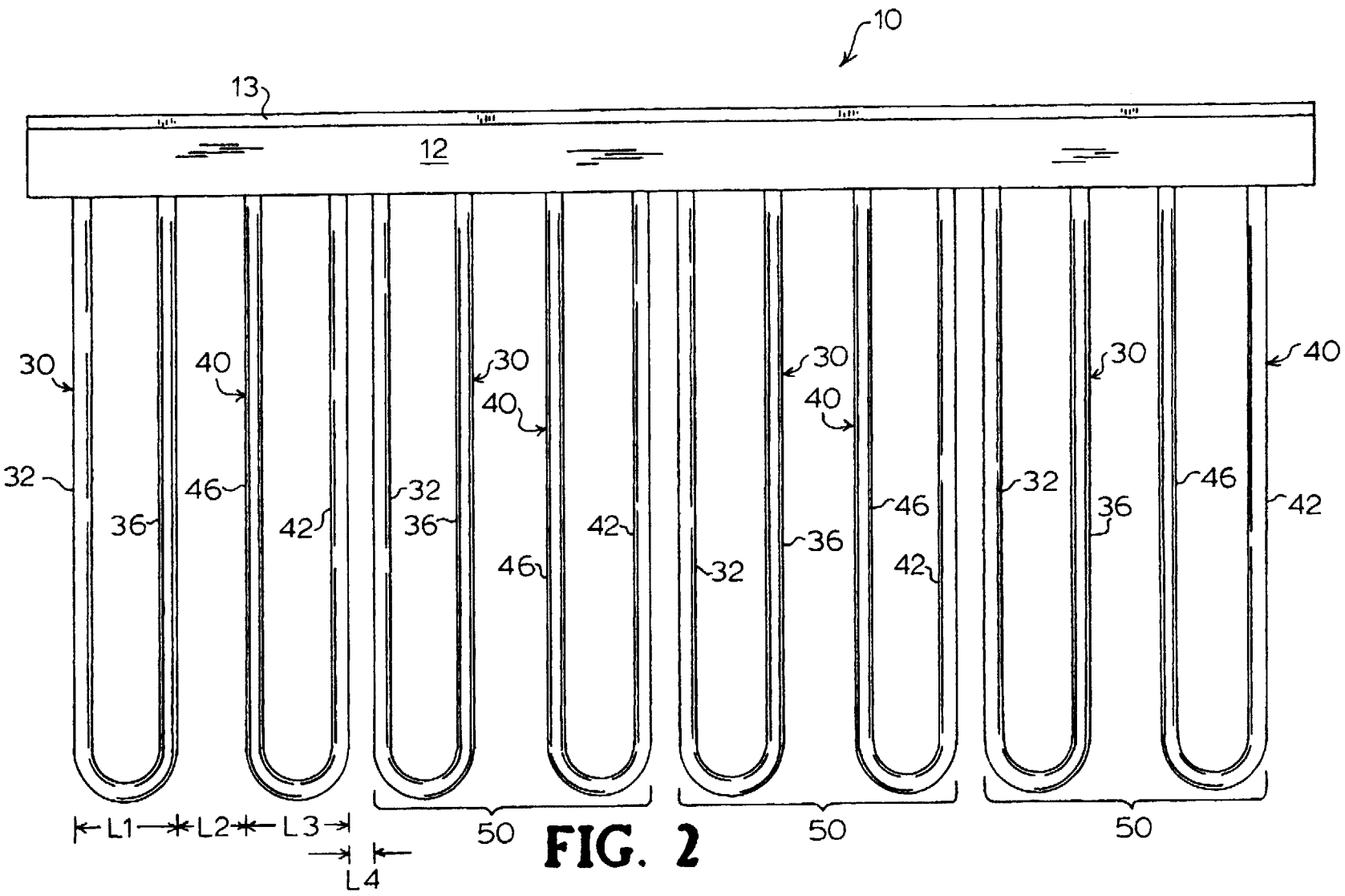
FIG. 2 is a top view of the combination drinking glass and wine glass rack of FIG. 1 with the phantom lines eliminated.
Figure 3:
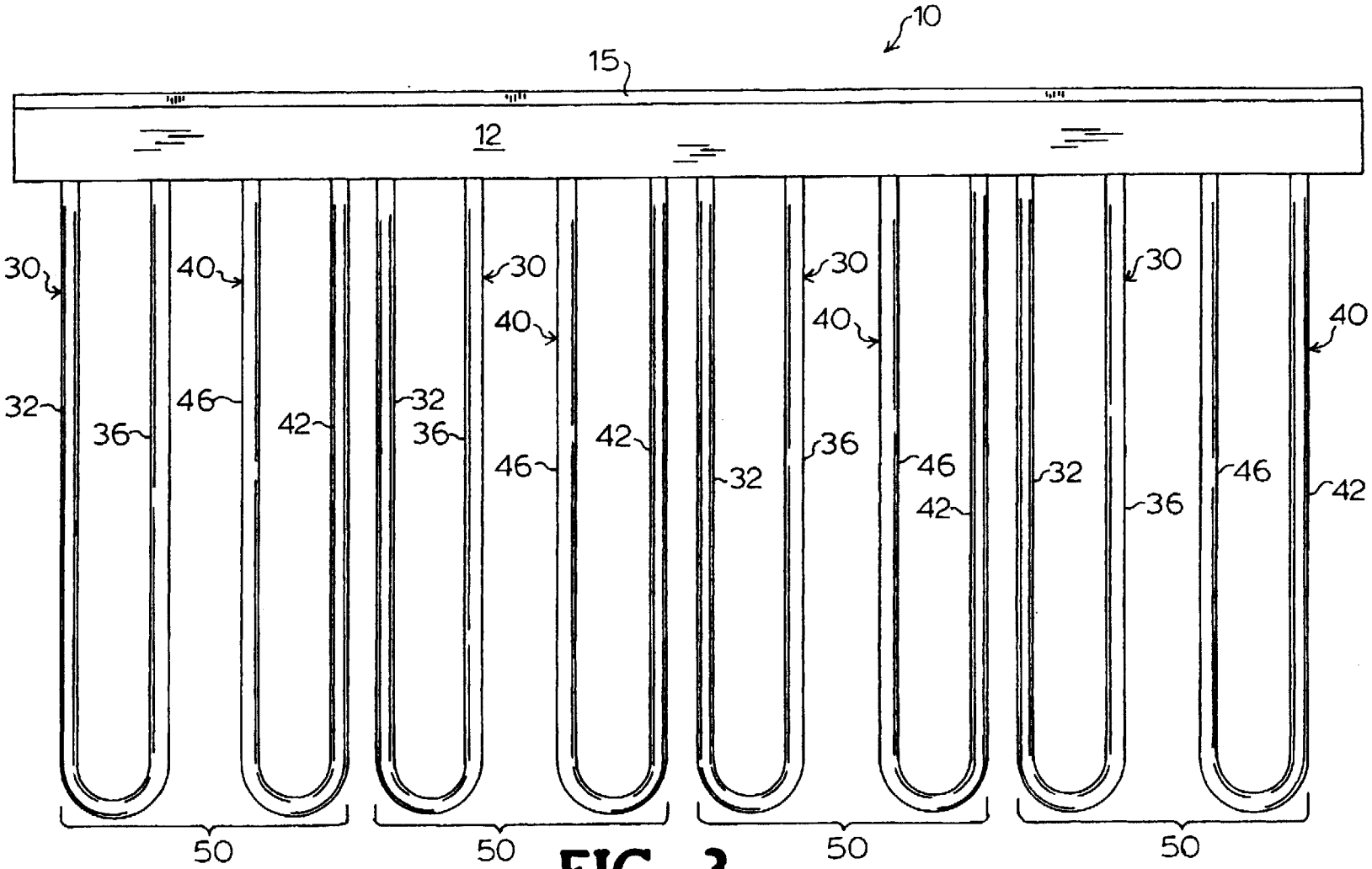
FIG. 3 is a bottom view of the combination drinking glass and wine glass rack of FIG. 1 with the phantom lines eliminated.

In use, support arms 30 and 40 are attached to board 12. One combination rack 10 is capable of accommodating several rows of glasses extending outwardly from support board 12 on support arms 30 and 40, as shown in FIG. 1. A typical combination rack 10 has four rows comprising four pairs 50 of support arms 30 and 40, as shown in FIGS. 2 and 3. Each pair 50 is comprised of downwardly angled support arm 30 adjacent to upwardly angled support arm 40, shown in FIGS. 1, 4 and 8. Lower rod portions 36 and 46 of each pair 50 are capable of supporting a plurality of bases and stems of wine glasses which are suspended from the lower rod portions, and of supporting a plurality of bases of drinking glasses, as shown in FIG. 1. Although not shown in FIG. 1, more than one glass can be placed on each pair of support arms. Upper rod portions 32 and 42 of each pair 50 stabilize the drinking glasses supported by lower rod portions 36 and 46.

It is a particular advantage of combination rack 10 that it is capable of accommodating varying sizes of glasses. This advantage is achieved through several features of combination rack 10: (1) the structure of support arms 30 and 40 themselves is capable of accommodating differing glass sizes; and (2) the adjustable attachment of support arms 30 and 40 to board 12 also provides the versatility of rack 10. First, as to the structure of arms 30 and 40, open space 31, shown in FIG. 9, between each upper rod portion 32 and lower rod portion 36, and between respectively each lower rod portion 46 and upper rod portion 42, permits varying diameters of bases of wine and drinking glasses to be accommodated when such glasses are supported by lower rod portions 36 and 46. Rather than being hindered by the support arms 30 and 40, glass bases can extend beyond lower rod portions 36 and 46 and through open space 31. Additionally, open space 31 permits the bases of glasses to be supported in a horizontal manner. If, for example, support arms 30 and 40 were solid pieces between upper rod portions 32 and lower rod portions 36, and upper rod portions 42 and lower rod portions 46, the bases of glasses supported on lower portions 36 and 46 would likely tilt more toward one arm than the other.

Second, as to the adjustable attachment of support arms 30 and 40 on board 12, the adjustability of rack 10 results from the adjustable placement and positioning of support arms 30 and 40 on board 12. The angle at which support arms 30 and 40 are attached to board 12, and the distance between each support arm 30 and 40 of each pair 50 permits differing sizes of glasses to be supported by rack 10. For example, the distance between upper rod portions 32 and upper rod portions 42 is adjustable to accommodate drinking glasses having different diameters. The greater the space between upper rod portions 32 and 42, the larger the drinking glass that can be accommodated. The distance between lower rod portions 36 and lower rod portions 46 is adjustable to accommodate different diameters of stems of wine glasses, as well as to accommodate different diameters of bases of drinking glasses. With the present invention, it is possible to accommodate a very narrow wine glass stem while at the same time accommodate, on the same row, a large diameter drinking glass.

Figure 4:
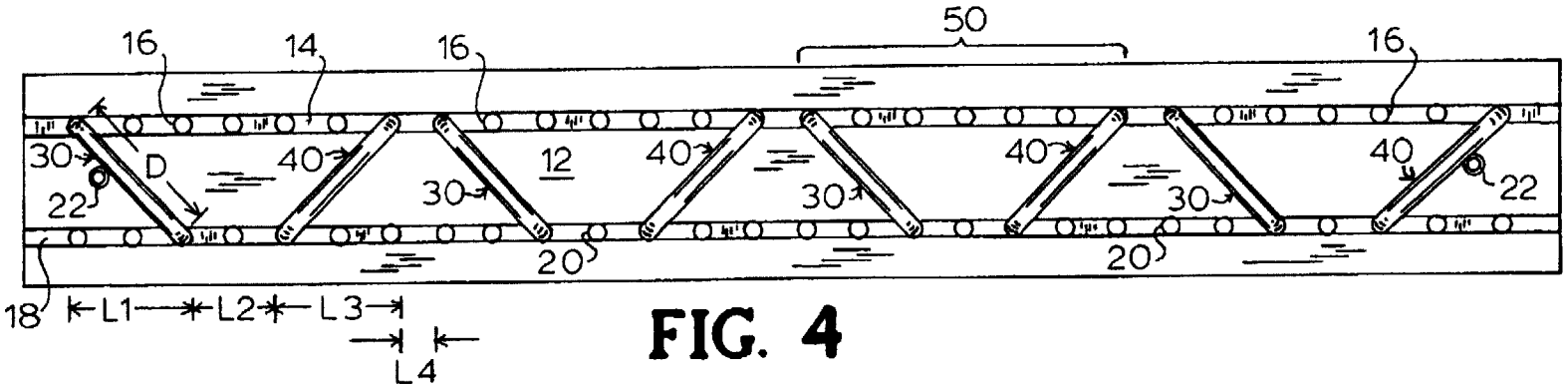
FIG. 4 is a front view of the combination drinking glass and wine glass rack of FIG. 1 with the phantom lines eliminated.
Figure 5:
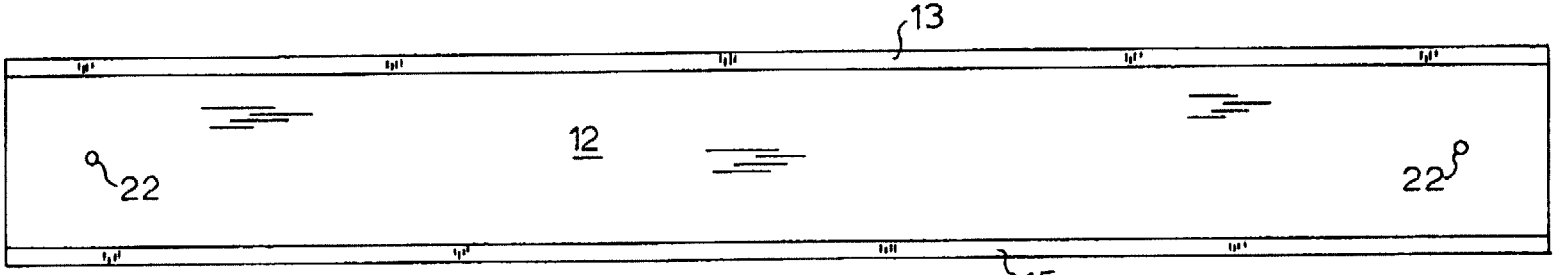
FIG. 5 is a back view of the combination drinking glass and wine glass rack of FIG. 1 with the phantom lines eliminated.

To create the downward angle of downwardly angled support arm 30, lower rod portion 36 is displaced along bottom row 18 from upper rod portion 32 by a distance L1 (FIGS. 2, 4 and 8). To create the upward angle of upwardly angled support arm 40, lower rod portion 46 is displaced along bottom row 18 toward support arm 30 from upper rod portion 42 by a distance L3 (FIGS. 2, 4 and 8). In each pair 50, L1 is preferably the same distance as L3, so that the downward angle of support arm 30 is the same as the upward angle of support arm 40. In spacing support arm 30 from support arm 40 in one pair 50, lower rod portion 36 is spaced a distance of L2 from lower portion 46. Pairs 50 are spaced apart on board 12 at a distance L4. The distances L1, L2 and L3 can be varied by adjusting the positioning of arms 30 and 40 on board 12. It is not critical to the use of the invention that the downward angle of support arm 30 be the same as the upward angle of arm 40. Because of the symmetry of drinking glasses, it is preferable that the angles be the same so that the glasses are equally supported by each arm 30 and 40; however, differently angled arms 30 and 40 are equally operational on rack 10. Additionally, while one set of positions is itself capable of accommodating several glass sizes, another set of positions provides further versatility in the sizes that can be accommodated by rack 10. By way of example, two suitable arrangements are shown in FIG. 4 and 8. Other arrangements are equally suitable.

A preferred method for adjustably attaching support arms 30 and 40 to board 12 is to provide apertures 16 on top attachment row 14, and apertures 20 on bottom attachment row 18 which are preferably vertically aligned with apertures 16 of top attachment row 14. A typical rack 10 comprises twenty-eight apertures 16 in row 14 and twenty-eight apertures 20 in row 18. For ease of use and construction, apertures 16 on top attachment row 14 and apertures 20 on bottom attachment row are vertically aligned, and equally spaced with respect to one another. However, it is appreciated that it is not necessary to the invention that apertures 16 and 20 be vertically aligned or evenly spaced.

Figure 6:
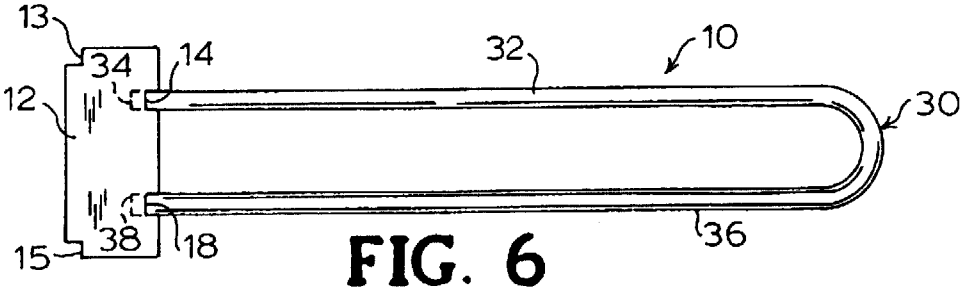
FIG. 6 is a left side view of the combination drinking glass and wine glass rack of FIG. 1 with the phantom lines eliminated.
Figure 7:
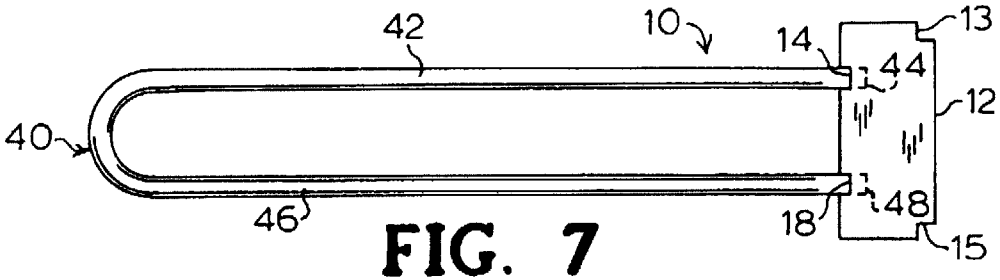
FIG. 7 is a right side view of the combination drinking glass and wine glass rack of FIG. 1 with the phantom lines eliminated.

For attachment to attachment rows 14 and 16, support arms 30 are structured to have upper ends 34 of upper rod portions 32, and lower ends 38 of lower rod portions 36, FIG. 6. Support arms 40 are structured to have upper ends 44 of upper rod portions 42 and lower ends 48 of lower rod portion 46, FIG. 7. Upper ends 34 and 44, and lower ends 38 and 48, are insertable respectively into apertures 16 and apertures 20 to hold support arms 30 and 40 in board 12. The angle formed by each downwardly angled support arm 30 is determined by the vertical displacement, distance L1, of apertures 16 and apertures 20 into which upper ends 34 and lower ends 38 are inserted, respectively. (If end 34 is inserted into an aperture 16 which is in precise vertical alignment with aperture 20 into which end 38 is inserted, support arm 30 forms a vertical plane). Therefore, to form a downwardly angled support arm 30 for a pair 50, lower end 38 of lower rod portion 36 is inserted into aperture 20 on bottom row 18 which is displaced in a direction toward adjacent support arm 40, preferably by a distance of one or two apertures 20, from aperture 16 into which upper end 34 of upper rod portion 32 is inserted, distance L1 shown in FIGS. 2–4 and 8. For each pair 50, lower end 48 of lower rod portion 42 of upwardly angled support arm 40 is inserted into an aperture 20 of bottom row 18 displaced horizontally along bottom row 18 at a distance desired to create the support for glasses, distance L2 as shown in FIGS. 2–4 and 8, preferably a distance of two or three apertures 20. To form the upward angle for support arm 40 of each pair 50, upper end 44 of upper rod portion 42 is inserted into an aperture 16 on top row 14, preferably one or two apertures 16 in a rightward direction from aperture 18 into which lower end 48 of lower rod portion 46 is inserted, distance L3.

A suitable arrangement for the attachment of arms 30 and 40 to board 12 is shown in FIG. 4. An alternative placement is shown in FIG. 8. The arrangement of FIG. 8 indicates smaller distances L1 and L3 than the arrangement in FIG. 4, and larger distances L2 and L4. The arrangement of FIG. 8 provides for greater stem widths of wine glasses if necessary. L4 varies in accordance with the need to equally space pairs 50 across board 10. FIGS. 4 and 8 illustrate a consistent arrangement of support arms 30 and 40 across board 12. It is understood that the upward and downward angles of arms 30 and 40 could vary between pairs 50, the only limitation being the length of board 12 and the number of apertures 16 and 20 available for positioning arms 30 and 40. It is noted that depending on distances L1 and L3, a different distance is formed between respectively ends 34 and 38 and between ends 44 and 48, shown in FIG. 4 as D and in FIG. 8 as D'. The flexibility of arms 30 and 40, as illustrated in FIG. 9 as flex F, enables upper and lower rod portions of support arms 30 and 40 to be squeezed together to D or D'. If L1 is small, for example one aperture, D' is smaller than D and ends 34 and 38, and ends 44 and 48, will have to be squeezed closer together. In this manner, the at least one pair 50 may be attached on board 12 in an easily adjustable manner in a plurality of positions to provide a combination drinking and wine glass rack capable of accommodating a number of varying sizes and style glasses.

Figure 10:
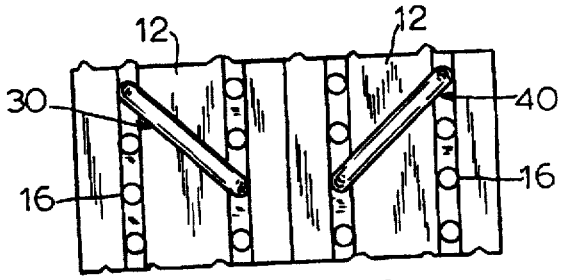
FIG. 10 is a front view of an alternative embodiment of the invention comprising a first glass rack placed adjacent to a second glass rack.

In an alternative embodiment of the invention, shown in FIG. 10, a first board 12 is supported in a vertical position adjacent to a second board 12. The first board 12 comprises at least one support arm 30 while the adjacent second board 12 comprises at least one support arm 40 placed adjacent to support arm 30 to form a pair 50. The location of support arms 30 and 40 on boards 12, and the spacing between respectively arms 30 and 40 are adjustable and depend on the types and sizes of glasses to be supported by the boards 12.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A combination drinking glass and wine glass rack comprising:

(a) a support board having a top attachment row and a bottom attachment row;

(b) at least one pair of support arms, each support arm comprising an upper rod portion and a lower rod portion, and each pair of support arms having a downwardly angled support arm adjacent to an upwardly angled support arm, such that when the pair of support arms is attached to the top and bottom attachment rows of the support board, the lower rod portions of each pair of support arms is capable of supporting a plurality of drinking glass bases positioned upon the lower rod portions and a plurality of wine glass bases suspended from the lower rod portions, and the upper rod portions of each support arm stabilize the drinking glasses positioned upon the lower rod portions; and (c) wherein said upper rod portion has an upper end and said lower rod portion has a lower end and the upper end of the upper rod portion of each support arm is attached to the top attachment row and the lower end of the lower rod portion of each support arm is attached to the bottom attachment row.

2. The combination drinking glass and wine glass rack of claim 1 wherein the top attachment row comprises a top row of apertures and the bottom attachment row comprises a bottom row of apertures.

3. The combination drinking glass and wine glass rack of claim 1 wherein the upper end on the upper rod portion of each support arm is inserted into an aperture on the top row of apertures and the lower end of the lower rod portion of each support arm is inserted into an aperture on the bottom row of apertures.

4. The combination drinking glass and wine glass rack of claim 1 wherein each support arm forms a u-shape with each rod portion of the support arm forming one side of the u-shape.

5. The combination drinking glass and wine glass rack of claim 1 wherein the apertures of the bottom row of apertures are vertically aligned with the apertures of the top row of apertures.

6. The combination drinking glass and wine glass rack of claim 1 further comprising four pairs of support arms.

7. An adjustable combination drinking glass and wine glass rack comprising:

(a) a support board having a top attachment row and a bottom attachment row;

(b) at least one pair of support arms, each support arm comprising an upper rod portion and a lower rod portion, and each pair of support arms having a downwardly angled support arm adjacent to an upwardly angled support arm and being attachable to the support board in a plurality of positions so that the pair of support arms is capable of supporting drinking glasses and wine glasses of different sizes and shapes, and in each position the lower rod portions of each pair of support arms are capable of supporting a plurality of drinking glass bases positioned on the lower rod portions, and a plurality of wine glass bases suspended from the lower rod portions, and the upper rod portions of each support arm stabilize the drinking glasses positioned upon the lower rod portions; and (c) wherein said upper rod portion has an upper end and said lower rod portion has a lower end and the upper end of the upper rod portion of each support arm is attached to the top attachment row and the lower end of the lower rod portion of each support arm is attached to the bottom attachment row.

8. The combination drinking glass and wine glass rack of claim 7 wherein the top attachment row comprises a top row of apertures and the bottom attachment row comprises a bottom row of apertures.

9. The combination drinking glass and wine glass rack of claim 8 wherein the upper ends on the upper rod portions of the support arms are insertable into a plurality of apertures of the top row of apertures, and the lower ends of the lower rod portions of the support arms are inserted into a plurality of apertures of the bottom row of apertures to form the plurality of positions.

10. The combination drinking glass and wine glass rack of claim 7 wherein each support arm forms a u-shape with each rod portion of the support arm forms one side of the u-shape.

11. The combination drinking glass and wine glass rack of claim 8 wherein the apertures of the bottom row of apertures is vertically aligned with the apertures of the top row of apertures.

12. The combination drinking glass and wine glass rack of claim 7 comprises four pairs of support arms.

* * * * *

UNITED STATES PATENT AND TRADEMARK OFFICE

CERTIFICATE OF CORRECTION

PATENT NO. : 5,711,436

DATED : January 27, 1998

INVENTOR(S) : Jens Peter Moeller; Henrik Holbaek; Claus Jensen

It is certified that error appears in the above-indentified patent and that said Letters Patent is hereby corrected as shown below:

Column 7, line 33,
In Claim 5, line 2, correct "claim 1" to read --claim 2--.

Signed and Sealed this

Fourteenth Day of April, 1998

Bruce Lehman

*Attest:*

BRUCE LEHMAN

*Attesting Officer*

*Commissioner of Patents and Trademarks*